US009903210B2

(12) United States Patent
Evans et al.

(10) Patent No.: US 9,903,210 B2
(45) Date of Patent: Feb. 27, 2018

(54) TURBINE BLADE TIP SHROUD

(71) Applicant: Siemens Energy, Inc., Orlando, FL (US)

(72) Inventors: Charles M. Evans, Tequesta, FL (US); Andrew R. Narcus, Loxahatchee, FL (US); John Pula, Jupiter, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 354 days.

(21) Appl. No.: 14/891,973

(22) PCT Filed: May 20, 2014

(86) PCT No.: PCT/US2014/038700
§ 371 (c)(1),
(2) Date: Nov. 18, 2015

(87) PCT Pub. No.: WO2014/189875
PCT Pub. Date: Nov. 27, 2014

(65) Prior Publication Data

US 2016/0108749 A1 Apr. 21, 2016

Related U.S. Application Data

(60) Provisional application No. 61/825,601, filed on May 21, 2013.

(51) Int. Cl.
*F01D 5/20* (2006.01)
*F01D 11/12* (2006.01)
(Continued)

(52) U.S. Cl.
CPC ..... *F01D 5/20* (2013.01); *F01D 5/147* (2013.01); *F01D 5/225* (2013.01); *F01D 11/122* (2013.01);
(Continued)

(58) Field of Classification Search
CPC . F01D 5/147; F01D 5/225; F01D 5/20; F01D 11/122; F01D 11/127;
(Continued)

(56) References Cited

U.S. PATENT DOCUMENTS 6,685,434 B1 2/2004 Humanchuk et al.
6,761,534 B1 7/2004 Willett
(Continued)

FOREIGN PATENT DOCUMENTS

EP 1609951 A1 12/2005

*Primary Examiner* — Woody Lee, Jr.
*Assistant Examiner* — Adam W Brown

(57) ABSTRACT

A turbine blade tip shroud (22C, 22D) with a seal rail (32C, 32D) oriented in a circumferential direction of rotation (29) relative to a turbine axis, and extending radially outward from the tip relative to the turbine axis. A first tooth (48, 68) and a second tooth (50, 70) form respective downstream and upstream lateral departures or bumps on the seal rail. Each tooth has a sharp top leading edge (48, 50, 68, 70) and a smoothly curved side surface (49, 51, 69, 71). A back portion (56, 76) of the seal rail may span linearly from a lateral peak (66, 78) of the second tooth to a back end (62) of the seal rail that is centered on an extended centerline (60) of a front portion (54, 74) of the seal rail. The teeth may be disposed proximate or over a stacking axis (52) of the blade.

10 Claims, 3 Drawing Sheets

(51) Int. Cl.
*F01D 5/22* (2006.01)
*F01D 5/14* (2006.01)
*F01D 11/00* (2006.01)

(52) U.S. Cl.
CPC ..... *F01D 11/127* (2013.01); *F01D 11/006* (2013.01); *F05D 2220/30* (2013.01); *F05D 2240/24* (2013.01); *F05D 2240/307* (2013.01); *F05D 2240/55* (2013.01); *F05D 2250/185* (2013.01)

(58) Field of Classification Search
CPC ..... F05D 2240/55; F05D 2240/24; F05D 2240/307; F05D 2220/30; F05D 2250/185
See application file for complete search history.

(56) References Cited

U.S. PATENT DOCUMENTS 6,805,530 B1 * 10/2004 Urban ..... F01D 5/225 415/173.4
6,832,897 B2 12/2004 Urban
6,851,931 B1 * 2/2005 Tomberg ..... F01D 5/141 415/173.1
6,857,853 B1 * 2/2005 Tomberg ..... F01D 5/147 415/914
6,881,038 B1 4/2005 Beddard et al.
6,890,150 B2 * 5/2005 Tomberg ..... F01D 5/141 277/415
6,893,216 B2 5/2005 Snook et al.
6,910,864 B2 6/2005 Tomberg
6,913,445 B1 7/2005 Beddard et al.
6,962,484 B2 * 11/2005 Brandl ..... F01D 5/16 415/173.4
7,001,144 B2 2/2006 Urban et al.
7,063,509 B2 6/2006 Snook et al.
7,094,023 B2 * 8/2006 Dube ..... F01D 5/225 415/173.1
7,094,032 B2 * 8/2006 Seleski ..... F01D 5/225 415/173.6
7,273,353 B2 7/2007 Dube et al.
7,419,361 B1 7/2008 Byam et al.
7,762,779 B2 * 7/2010 Zemitis ..... F01D 5/225 415/173.4
8,192,166 B2 * 6/2012 Beeck ..... F01D 11/08 415/173.6
8,317,465 B2 * 11/2012 Smith ..... F01D 5/225 415/173.6
8,807,928 B2 * 8/2014 Kareff ..... F01D 5/143 415/173.6
9,441,489 B2 * 9/2016 Saxer ..... F01D 5/20
9,464,530 B2 * 10/2016 Kareff ..... F01D 5/30
2004/0208743 A1 10/2004 Urban
2010/0290897 A1 11/2010 Beeck et al.
2012/0195742 A1 * 8/2012 Jain ..... F01D 11/122 415/173.1
2013/0084169 A1 4/2013 Kareff et al.

* cited by examiner

FIG 1
PRIOR ART
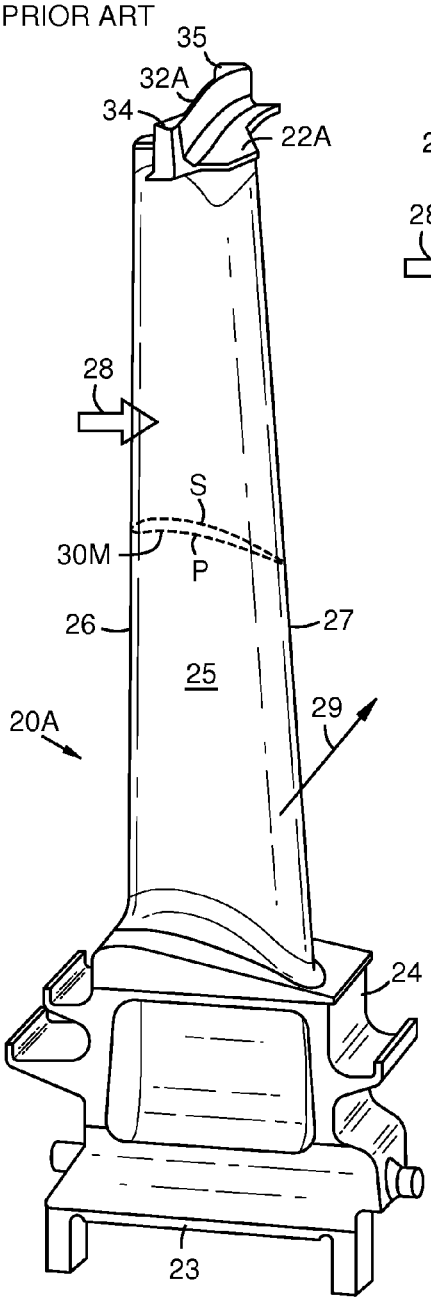
FIG 2
PRIOR ART
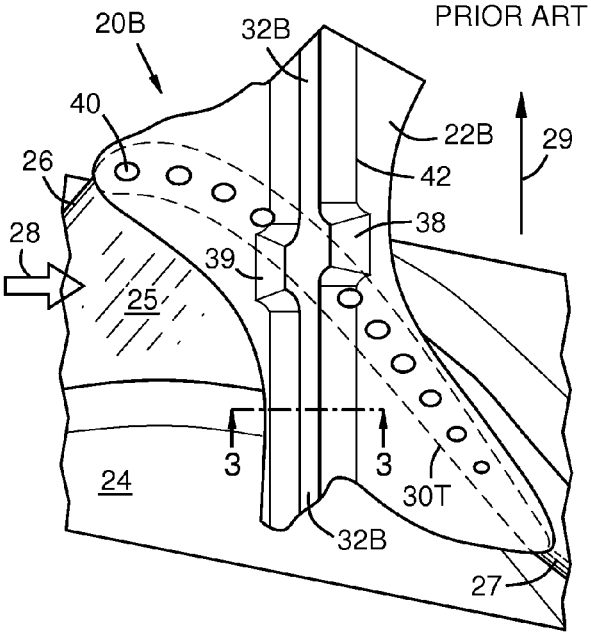
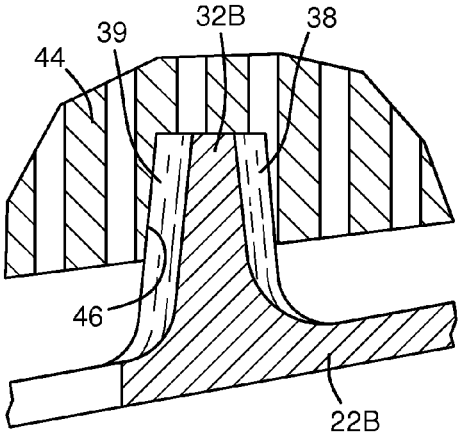
FIG 3
PRIOR ART

TURBINE BLADE TIP SHROUD

This application is the US National Stage of International Application No. PCT/US2014/038700 filed May 20, 2014, and claims the benefit thereof. The International Application claims benefit of the 21 May 2013 filing date of U.S. provisional patent application No. 61/825,601. All applications are incorporated by reference herein.

FIELD OF THE INVENTION

The invention relates to gas turbine blade tip shrouds and particularly to a seal rail and cutter tooth configuration for a tip shroud.

BACKGROUND OF THE INVENTION

A gas turbine blade has a tip that closely brushes a surrounding shroud. The shroud channels the working gas flow through circular arrays of blades. Each circular array is called a turbine stage, the first stage being just after the combustion section. The inner lining of the shroud is made abradable so that the blade tips can cut a path in it to minimize the blade tip-to-shroud clearance. This minimizes leakage of the working gas from the pressure side to the suction side of each blade. Some blade designs include a tip shroud as shown in FIG. 1, which is a plate on the blade tip. A seal rail may extend radially outward from the plate. The rail is aligned circumferentially along the rotation direction. It cuts a narrow groove in the shroud lining for working gas sealing. The rail may include wider portions called teeth that cut the groove wider than the rail to allow for proper blade to shroud clearances for tolerances and rotor axial movement.

A disadvantage of adding a tip shroud and seal rail to a blade design is added weight. Cantilevered portions of the tip shroud must be rigid to resist flexing from centrifugal force. This limits possible weight reductions.

BRIEF DESCRIPTION OF THE DRAWINGS

The invention is explained in the following description in view of the drawings that show:

FIG. 1 is a perspective view of a prior art turbine blade with a tip shroud.

FIG. 2 is a top view of a prior art tip shroud and seal rail.

FIG. 3 is a sectional view taken on line 3-3 of FIG. 2.

DETAILED DESCRIPTION OF THE INVENTION

Figure 4:
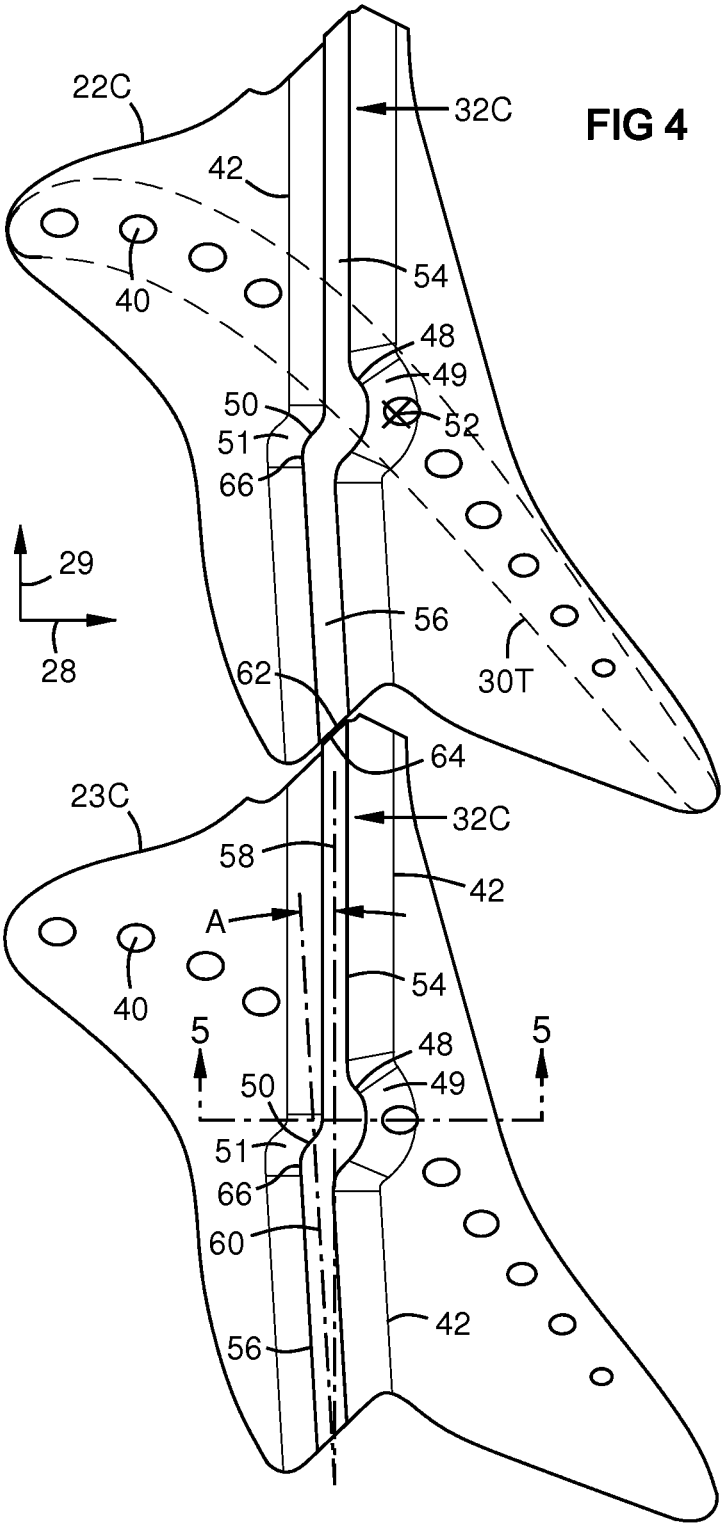
FIG. 4 is a top view of two adjacent tip shrouds showing aspects of an embodiment of the invention.

FIG. 1 shows a prior art turbine blade 20A with a tip shroud 22A. The blade has a root 23, a platform 24, and an airfoil 25 with a leading edge 26 and a trailing edge 27. A transverse profile 30M of the airfoil midsection is shown with a pressure side P and a suction side S. An axial direction 28 of the working gas flow and a circumferential direction 29 of blade rotation are shown. "Axial" means parallel to the turbine rotation axis. The circumferentially oriented seal rail 32A has wider portions or teeth 34, 35 for cutting a groove in the shroud liner.

FIG. 2 is a top view of a prior art turbine blade 20B showing a tip shroud 22B, a platform 24, and an airfoil 25 with a leading edge 26 and a trailing edge 27. A transverse profile 30T of the airfoil tip is shown with a dashed line. An axial direction 28 of the working gas flow and a circumferential direction 29 of blade rotation are shown. A circumferentially oriented seal rail 32B has first and second teeth 38, 39 for cutting a groove in the shroud liner. Cooling air outlets 40 pass through the tip shroud from cooling chambers in the airfoil 25. The rail and teeth have fillets 42.

FIG. 3 is a sectional view taken on line 3-3 of FIG. 2, showing an abradable shroud liner 44 with a groove 46 therein that is cut by the teeth 38, 39. Abradable shroud liners are made of ceramic that may be porous and/or may have a honeycomb structure to increase abradability. Gas leakage over the blade tip is impeded by the top of the seal rail 32B closely clearing the top of the groove 46.

FIG. 4 is a top view of two adjacent tip shrouds 22C, 23C showing aspects of an embodiment of the invention. An axial direction 28 of the working gas flow and a circumferential direction 29 of blade rotation are shown. A circumferentially oriented seal rail 32C has first and second teeth 48, 50 for cutting a groove in the shroud liner. The first tooth 48 or both teeth may be proximate or over a stacking axis 52 of the blade. The stacking axis is a radial line from the turbine axis through the center of mass of the blade. Proximity of the teeth to the stacking axis minimizes bending moment on the blade about the stacking axis. Cooling air outlets 40 may pass through the tip shroud from cooling chambers in the blade via the blade tip 30T. The rail and teeth may have fillets 42.

The teeth 48, 50 may be smoothly rounded or bumps extending upstream and downstream from the seal rail 32C. The top leading edge of each tooth (the edge touched by lead lines 48, 50) may be sharp, with an included angle B (FIG. 5) such as 90 to 100 degrees when viewed in section, while the side surfaces 49, 51 may be smoothly rounded. This combination produces clean cutting by the sharp edges plus smoothing of the sides of the groove 46 (FIG. 5) by the rounded sides of the teeth. The sides 49, 51 can fly on the boundary layer of gas on the sides of the groove in some conditions, minimizing resistance. Such an air bearing effect is maximized by the tooth sides being smooth and rounded. Only one tooth 48, 50 is needed on each side of the rail 32C.

The rail 32C may have front and back portions 54, 56 with respect to the rotation direction 29. The front portion 54 of the rail is ahead of the teeth 48, 50. It may be aligned with the rotation direction 29 as shown by centerline 58. The back portion 56 of the rail is behind the teeth. It may be angled back to the extended front centerline 58 as shown so that the back end 62 of the rail aligns with the front end 64 of the rail on the following tip shroud 23C. The back portion 56 of the rail may span linearly from the peak 66 or maximum lateral extent of the back tooth 50 to the back end of the rail 62 centered on the extended centerline 58. This configuration minimizes mass in the back portion 56 of the rail for a given width thereof, since the shortest distance between two points is a straight line. The angle A between centerlines 58, 60 of the front and back portions of the rail may be in a range such as 2 to 3 degrees.

The tip shroud and seal rail as shown in FIG. 4 may be used in original turbine manufacture or on replacement blades, which are also called buckets. This provides reduced mass and friction over the prior art of FIG. 2.

Figure 5:
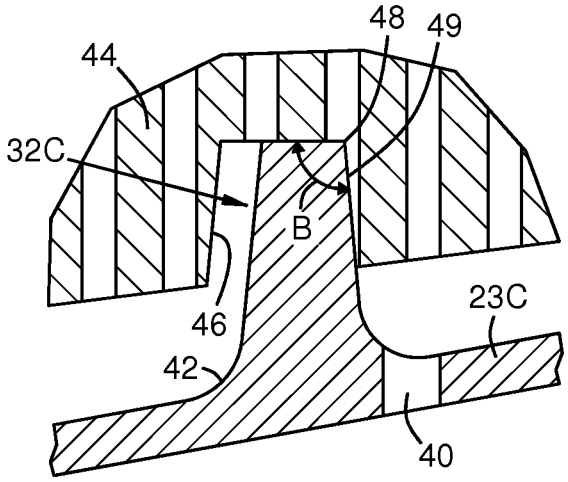
FIG. 5 is a sectional view taken on line 5-5 of FIG. 4.

FIG. 5 is a sectional view taken on line 5-5 of FIG. 4, showing an abradable shroud liner 44 with a groove 46 cut therein by the teeth 48, 50 of FIG. 4.

Figure 6:
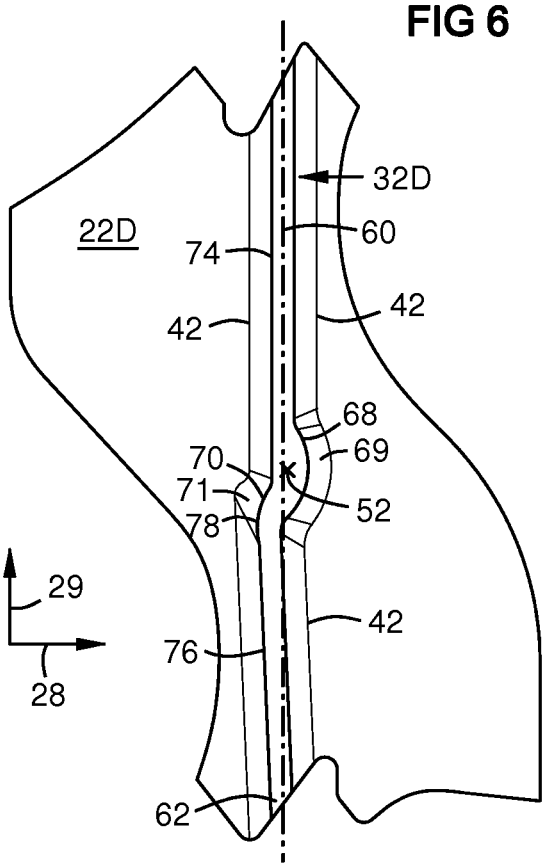
FIG. 6 is a top view of a tip shroud showing aspects of a second embodiment of the invention.

FIG. 6 is a top view of a tip shroud 22D with aspects of a second embodiment of the invention. An axial direction 28 of the working gas flow and a circumferential direction 29 of blade rotation are shown. A circumferentially oriented seal rail 32D has first and second teeth 68, 70 for cutting a groove in the shroud liner. The first tooth 68 or both teeth may be proximate or over the stacking axis 52 of the blade. The rail and teeth may have fillets 42.

The teeth 68, 70 may be formed by smoothly rounded lateral departures or bumps on the seal rail 32D as shown. The top leading edge of each tooth (the edge touched by lead lines 68, 70) may be sharp, while the sides 69, 71 may be smoothly rounded. Only one tooth 68, 70 is needed on each side of the rail 32D.

The rail 32D may have front and back portions 74, 76 with respect to the rotation direction 29. The front portion 74 is ahead of the teeth 68, 70, and may be aligned with the rotation direction 29. The back portion 76 is behind the teeth. It may span linearly from the peak 78 or maximum lateral extent of the back tooth 70 to a back end 62 of the seal rail that is centered on an extended centerline 60 of the front portion 72 of the rail. This configuration minimizes mass in the back portion 76 of the rail for a given width thereof, since the shortest distance between two points is a straight line. The front and back portions 74, 76 of the rail may have a common uniform thickness, although this is not a requirement.

The tip shroud and seal rail as shown in FIG. 6 may be used in original turbine manufacture or on replacement blades, which are also called buckets.

The teeth pairs 48/50, 68/70 may be formed in a comma shape as viewed from above (FIGS. 4 and 6). This forms a smooth transition and allows a more constant rail thickness than in prior art (FIG. 2), resulting in more uniform cooling and thermal expansion of the rail.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A turbine blade tip shroud, comprising a seal rail oriented in a circumferential direction of rotation relative to a turbine axis, and extending radially outward from a shroud relative to the turbine axis; and a first tooth and a second tooth extending respectively downstream and upstream from the seal rail with respect to a working gas flow, each tooth comprising a sharp top leading edge and a smoothly curved side surface;

wherein a back portion of the seal rail spans linearly from an upstream peak of the second tooth to a back end of the seal rail that is centered on an extended centerline of a front portion of the seal rail.

2. The turbine blade tip shroud of claim 1, wherein the back portion of the seal rail forms an angle of 2 to 3 degrees relative to the extended centerline of the front portion of the seal rail.

3. The turbine blade tip shroud of claim 1, wherein the sharp top leading edge of each tooth comprises an included angle of 90 to 100 degrees between a top surface of the tooth and the side surface thereof as seen in section.

4. The turbine blade tip shroud of claim 1, wherein the first tooth is proximate a radius of the turbine axis that passes through a center of mass of the blade.

5. A turbine blade tip shroud, comprising:

a plate on a tip of a turbine blade;

a seal rail oriented in a circumferential direction of rotation relative to a turbine axis, the seal rail extending radially outward from the plate relative to the turbine axis;

a first tooth forming a lateral bump on a downstream side of the seal rail with respect to a working gas flow, the first tooth comprising a sharp top leading edge;

a second tooth forming a lateral bump on an upstream side of the seal rail with respect to the working gas flow, the second tooth comprising a sharp top leading edge;

the seal rail comprising a front portion ahead of the first tooth with respect to the direction of rotation and a back portion behind the second tooth with respect to the direction of rotation, wherein the back portion of the seal rail spans linearly from a lateral peak of the second tooth to a back end of the seal rail that is centered on an extended centerline of the front portion of the seal rail.

6. The turbine blade tip shroud of claim 5, wherein the back portion of the seal rail forms an included angle of 2 to 3 degrees with the extended centerline of the front portion of the seal rail.

7. The turbine blade tip shroud of claim 5, wherein each of the teeth has a smoothly curved side surface.

8. The turbine blade tip shroud of claim 5, wherein the sharp top leading edge of each tooth comprises an included angle of 90 to 100 degrees between a top surface of the tooth and a side surface thereof as seen in section.

9. The turbine blade tip shroud of claim 5, wherein the teeth are proximate or over a radius of the turbine axis that passes through a center of mass of the blade.

10. A turbine blade tip shroud, comprising a seal rail oriented in a circumferential direction of rotation relative to a turbine axis, and extending radially outward from the shroud relative to the turbine axis; and a first tooth and a second tooth extending from the seal rail respectively downstream and upstream with respect to a working gas flow, the first and second teeth forming a continuously smooth comma-shaped transition between a front portion of the seal rail and a back portion thereof as viewed from above;

wherein the back portion of the seal rail spans linearly from an upstream peak of the second tooth to a back end of the seal rail that is centered on an extended centerline of the front portion of the seal rail.

* * * * *